US010039379B1

(12) United States Patent
Phillips et al.

(10) Patent No.: US 10,039,379 B1
(45) Date of Patent: Aug. 7, 2018

(54) MATERIAL SUPPORT AND STORAGE RACK

(71) Applicants: Kevin Phillips, Newport, RI (US); Kenneth Phillips, Bolton Valley, VT (US)

(72) Inventors: Kevin Phillips, Newport, RI (US); Kenneth Phillips, Bolton Valley, VT (US)

( * ) Notice: Subject to any disclaimer, the term of this patent is extended or adjusted under 35 U.S.C. 154(b) by 0 days.

(21) Appl. No.: 15/432,561

(22) Filed: Feb. 14, 2017

(51) Int. Cl.

| | |
|---|---|
| ***A47B 23/04*** | (2006.01) |
| ***A47B 43/00*** | (2006.01) |
| ***A47B 47/00*** | (2006.01) |
| ***A47B 57/00*** | (2006.01) |
| ***A47F 5/00*** | (2006.01) |
| ***A47B 45/00*** | (2006.01) |
| ***A47B 95/00*** | (2006.01) |
| ***E06C 1/00*** | (2006.01) |
| ***A47F 5/10*** | (2006.01) |
| ***A47F 5/08*** | (2006.01) |
| ***E06C 1/38*** | (2006.01) |
| ***E06C 1/22*** | (2006.01) |

(52) U.S. Cl.
CPC ..... *A47B 43/00* (2013.01); *A47B 45/00* (2013.01); *A47B 95/008* (2013.01); *A47F 5/08* (2013.01); *A47F 5/10* (2013.01); *E06C 1/005* (2013.01); *E06C 1/22* (2013.01); *E06C 1/381* (2013.01)

(58) Field of Classification Search
CPC ..... A47B 43/00; A47B 45/00; A47B 95/008; A47B 46/00; A47B 46/005; A47B 53/00; A47B 57/004; A47B 57/045; A47B 85/00; A47B 97/04; A47B 2220/05; F16M 11/32; F16M 11/38; F16M 11/28; F16M 11/26; F16M 11/24; A47F 5/08; A47F 5/10; A47F 2005/165; A47F 5/16; A47F 5/105; A47F 5/12; E06C 1/20; E06C 7/423; E06C 7/44; E06C 1/16; E06C 1/18; E06C 1/22; E06C 1/32; E06C 1/393; E06C 1/30; E06C 1/381; E06C 1/005; E06C 1/12; E06C 1/125; E06C 1/14; E06C 1/38
USPC ..... 248/170, 171, 436, 165, 166, 439, 454, 248/455, 457; 211/90.02, 2, 195, 198, 211/203, 169.1, 150, 149, 1.3, 175; 206/45.2, 45.24, 223, 577, 549; 182/170, 182/165, 189, 20; 108/16, 19, 11, 12
See application file for complete search history.

(56) References Cited

U.S. PATENT DOCUMENTS 315,022 A * 4/1885 Gray ..... A47B 3/00 108/99
508,816 A * 11/1893 Craig ..... E06C 1/381 182/156

(Continued)

*Primary Examiner* — Jennifer E. Novosad
(74) *Attorney, Agent, or Firm* — Justin W. McCabe; Dunkiel Saunders Elliott Raubvogel & Hand PLLC

(57) ABSTRACT

A storage device that has a wall-mounted configuration and a freestanding configuration is provided and includes a first vertical support with one or more horizontal support members pivotably attached at intervals to the first vertical support, and includes a plurality of second vertical supports hingeably attached to the first vertical support on a first end of the vertical support, wherein the first vertical support and the second vertical supports can be collapsed together to form a wall-mountable vertical support that can be releasably attached to a wall-mounted bracket.

7 Claims, 7 Drawing Sheets

(56) References Cited

U.S. PATENT DOCUMENTS 785,277 A * 3/1905 Smith ..... E06C 1/20 182/169
799,360 A * 9/1905 Smith ..... E06C 1/381 182/189
1,086,746 A * 2/1914 Babbitt ..... A45C 9/00 190/16
1,197,610 A * 9/1916 Darling ..... A45C 9/00 190/16
1,265,922 A * 5/1918 Lanier ..... A47B 23/042 182/176
1,342,236 A * 6/1920 Szako ..... B23D 63/003 248/166
1,412,179 A * 4/1922 Hoen ..... E06C 1/381 182/107
1,673,205 A * 6/1928 Romao ..... G10G 5/00 211/85.6
1,896,604 A * 2/1933 Bales ..... A47F 5/108 108/100
1,944,649 A * 1/1934 Smith, Sr. ..... A47F 7/08 211/150
1,964,124 A * 6/1934 Keller ..... A47F 5/10 108/96
1,976,345 A * 10/1934 Hruby ..... E06C 1/20 182/108
2,136,109 A * 11/1938 Kress ..... A47F 5/12 211/150
2,276,211 A * 3/1942 Lane ..... A47G 25/0664 211/2
2,538,318 A * 1/1951 Mitchell ..... B41J 29/15 248/448
2,844,897 A * 7/1958 Vance, Jr. ..... E01F 9/688 248/166
3,095,834 A * 7/1963 Killen ..... A47B 85/06 108/1
3,368,786 A * 2/1968 Bulman ..... A47B 97/08 108/106
3,371,798 A 3/1968 D'Altrui
4,042,203 A * 8/1977 Warkentin ..... A47B 97/08 248/449
4,113,056 A 9/1978 DeLorenzo
4,124,093 A 11/1978 Breisch
4,146,941 A * 4/1979 Haslam ..... B63B 27/14 114/362
D262,076 S * 12/1981 Pracon ..... D6/407
4,524,849 A * 6/1985 Riddle ..... E06C 1/20 182/170
4,691,610 A * 9/1987 Gilbert ..... F16M 11/22 248/168
4,770,380 A * 9/1988 Eason ..... F16M 11/28 248/165
5,143,181 A * 9/1992 Bixby ..... B66B 9/16 182/103
5,197,701 A * 3/1993 Olson ..... G10G 5/00 248/166
5,273,248 A * 12/1993 Grander ..... A47B 85/00 211/2
5,482,168 A 1/1996 Welch
5,551,580 A 9/1996 Knutson
5,590,796 A * 1/1997 Herman ..... A47F 5/108 108/99
5,626,379 A * 5/1997 Scott ..... A47B 81/005 211/195
5,833,178 A * 11/1998 Plasse ..... A01G 5/02 248/27.8
6,206,139 B1 * 3/2001 Bogart, Jr. ..... E06C 1/22 182/166
6,269,958 B1 8/2001 Pollock
6,457,685 B1 * 10/2002 Taylor ..... F41A 23/18 124/41.1
7,434,661 B1 * 10/2008 Storey ..... E06C 1/36 182/100
7,866,491 B2 1/2011 Newman
8,281,943 B2 * 10/2012 Suman ..... A47F 5/0087 211/150
8,464,988 B1 * 6/2013 Walker ..... F16M 11/38 108/50.01
8,870,148 B2 * 10/2014 Hickman ..... A47B 97/04 211/119.004
2007/0145205 A1 * 6/2007 Liang ..... A47B 37/04 248/163.1
2008/0053928 A1 3/2008 Klauer
2008/0210490 A1 * 9/2008 Guering ..... B60R 3/02 182/97
2012/0267329 A1 * 10/2012 Herman Baran et al. ..... A47F 1/06 211/59.2
2012/0312202 A1 12/2012 Burnett

* cited by examiner

MATERIAL SUPPORT AND STORAGE RACK

FIELD OF THE INVENTION

The present invention generally relates to devices used for storing or supporting materials. In particular, the present invention is directed to a storage rack that can be used in a wall-mounted configuration and in a freestanding configuration.

BACKGROUND

Storage racks can be secured to a ceiling or wall, or be freestanding. Such racks may have shelving or horizontal supports for holding longer materials such as lumber or pipes. Other devices, such as sawhorses, are designed for supporting materials while the materials are being worked on, such as being cut or painted, or while they are airing out or drying.

A primary design concern for storage racks, in addition to structural integrity, is efficient use of space. Generally, storage racks should not occupy more space than necessary, e.g., in a garage or closet. On the other hand, devices for supporting materials that are being worked on, such as sawhorses, are designed for stability with less concern for the size of their footprint since these devices are meant to support materials, such as lumber, only temporarily while the materials held are being worked on.

What is needed is a device that can serve as both a space-efficient storage rack and a stable, portable, and freestanding rack that can be used to store materials where needed or support materials to be worked on in a variety of locations.

SUMMARY OF THE DISCLOSURE

A device is provided with a wall-mounted configuration and a freestanding configuration and includes a first vertical support with a top end, a front side, and a plurality of horizontal support members pivotably attached at intervals to the first vertical support, wherein the horizontal support members can be releasably placed in at least two locked positions and a plurality of second vertical supports hingeably attached to the top end of the first vertical support, wherein the first vertical support and the second vertical supports can be collapsed together to form a third vertical support that can be releasably attached to a wall-mounted bracket.

Another embodiment disclosed is a device with a wall-mounted configuration and a freestanding configuration that includes a first vertical support with a top end and a front side, two second vertical supports hingeably attached to the top end of the first vertical support, wherein the first vertical support and the second vertical supports can be collapsed together to form a third vertical support that can be releasably attached to a wall-mounted bracket such that when attached to the wall-mounted bracket the third vertical support is substantially vertical with the top end facing up, and wherein the first vertical support and the second vertical supports can form a tripod that supports the device in a freestanding position, and a plurality of horizontal support members pivotably attached at intervals to the first vertical support, each horizontal support member having a top surface, wherein the horizontal support members can be placed in at least three locked positions including a first position in which the top surface is substantially flush with the front side of the first vertical support, a second position in which the top surface extends away from the front side of the first vertical support and is substantially horizontal when the device is in the freestanding position, and a third position in which the top surface extends away from the front side of the first vertical support and is substantially horizontal when the device is attached to the wall-mounted bracket.

Another disclosed embodiment is a rack for materials having a first vertical support with a top end and a front side, two vertical supports hingeably attached to the top end of the first vertical support, wherein the first vertical support and the second vertical supports can be collapsed together to form a third vertical support that can be releasably attached to a wall-mounted bracket such that when attached to the wall-mounted bracket the third vertical support is substantially vertical with the top end facing up, and wherein the first vertical support and the second vertical supports can form a tripod that supports the rack in a freestanding position, and a horizontal support member pivotably attached to the first vertical support, the horizontal support member having a top surface, wherein the horizontal support member can be placed in at least three positions including a first position in which the top surface is substantially flush with the front side of the first vertical support, a second position in which the top surface extends away from the front side of the first vertical support and is substantially horizontal when the device is in the freestanding position, and a third position in which the top surface extends away from the front side of the first vertical support and is substantially horizontal when the device is attached to the wall-mounted bracket.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

A storage rack system of the present invention allows one or more storage racks to be used as both a wall-mounted rack and as a freestanding rack. In a freestanding configuration, the storage rack can be used alone or in pairs to form a support for materials that can be worked on. The rack may include shelves at various heights to accommodate different types of tasks and different sized workers. In addition, telescoping support legs allow the rack to be stable on uneven or sloping surfaces. When not needed in the freestanding configuration, the rack of the present invention is collapsible into a wall-mounted configuration that can be securely hung on a wall. In this configuration, the rack does not take up as much space yet the shelves are available to be used for storage if desired or folded flush if not needed so as to take up even less space.

The storage rack can include three legs in which one of the legs includes a plurality of horizontal supports that can be locked at an angle appropriate for supporting materials based on the angle of the leg when the storage rack is in the freestanding position. The three legs can be repositioned so that the three legs form a single leg for use in the wall-mounted configuration. In the wall-mounted configuration, the storage rack can be mounted to mounting brackets and the horizontal supports can be locked at an angle appropriate for supporting materials when the storage rack is mounted vertically, or locked flush against the leg.

Figure 1:
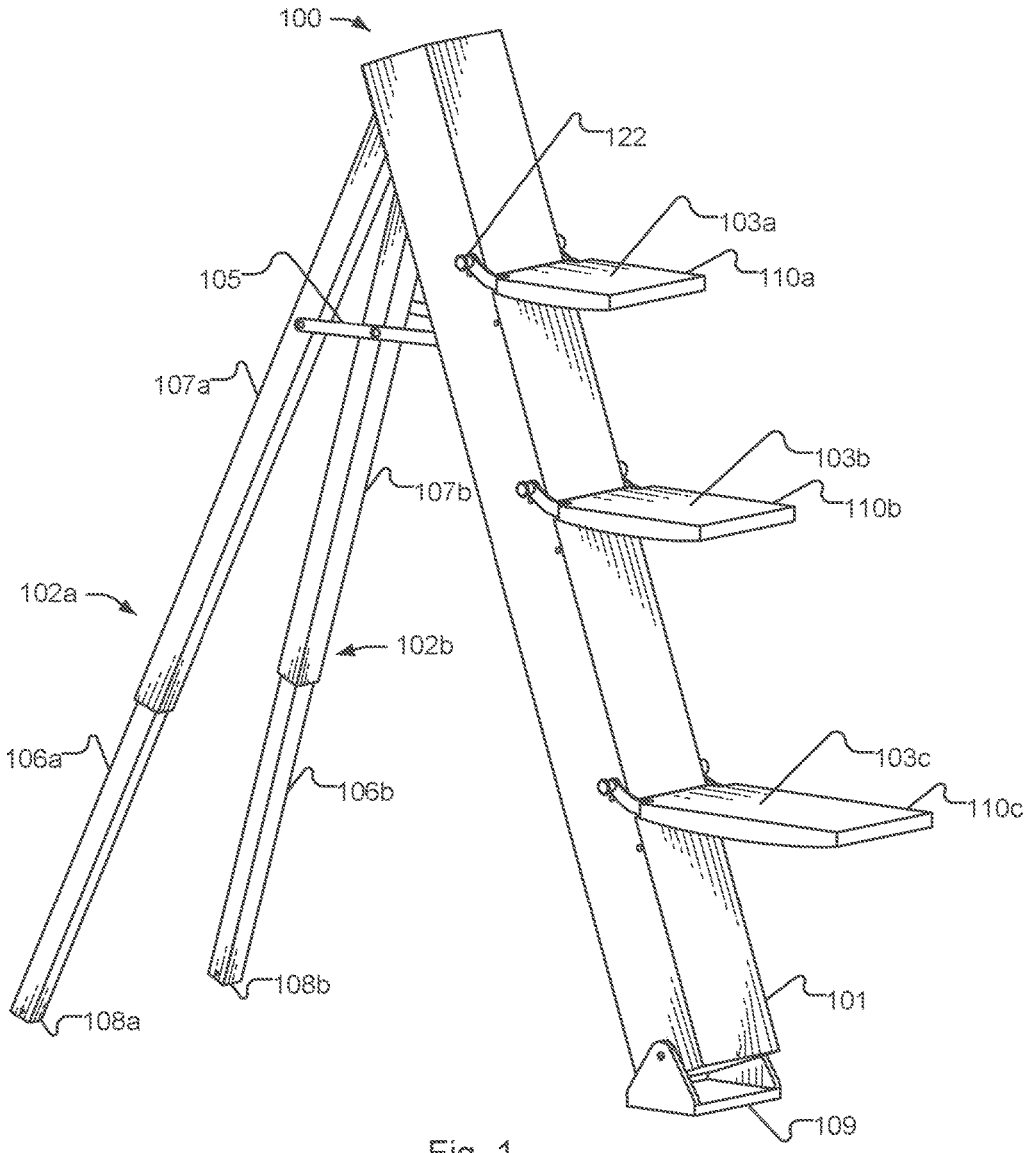
FIG. 1 is a perspective view of a storage rack according to an embodiment of the present invention.

Turning now to the figures, FIG. 1 shows an exemplary storage rack 100 in a freestanding configuration according to an embodiment of the present disclosure. Storage rack 100 includes a primary leg 101, secondary legs 102 (e.g., 102*a* and 102*b*), and arms 110 (e.g., 110*a*, 110*b* and 110*c*). Primary leg 101 can be of any suitable height, and preferably about two to about eight feet. Primary leg 101 and secondary legs 102 are preferably hingeably connected at a top of storage rack 100 and can be angled in order to form a suitably stable structure in a freestanding configuration so that storage rack 100 can support materials for storage or for being worked on.

A bar 105 may connect the secondary legs to reinforce stability in the freestanding configuration. Bar 105 may be disengaged via a hinge or other suitable mechanism in the bar 105 or by being detachable from one or more of the secondary legs 102 via a slot or other suitable mechanism. In addition, or in the alternative, a similar support (not shown) can be attached between primary leg 101 and one or more of secondary legs 102 to confer additional stability while storage rack 100 is in the freestanding configuration.

The secondary legs 102 may of adjustable length in order to accommodate uneven or sloping ground when storage rack 100 is in the freestanding configuration. This vertical adjustability may be accomplished by including, for example, two telescoping sections, a lower section 106 (e.g., 106*a* and 106*b*) and an upper section 107 (e.g., 107*a* and 107*b*) that can slide into each other and be locked in place with a suitable locking mechanism, such as a pin and hole system or a clamping system. The adjustability of secondary legs 102 also allows primary leg 101 to be stably held at a preferred angle when in the freestanding position even on sloped or uneven surfaces.

Secondary legs 102 may also include feet 108 (e.g., 108*a* and 108*b*), which can have a rubber or other suitable non-slip portion. Further, feet 108 may be angled or pivotable such that feet 108 rest generally flush with a surface storage rack 100 is on when in the freestanding configuration.

Primary leg 101 may also include a base 109. Base 109 can help confer stability to storage rack 100 in the freestanding configuration. Base 109 can have a rubber or other suitable non-slip portion. Further, base 109 may be angled or pivotable such that base 109 rests generally flush with the surface storage rack 100 is on when in the freestanding configuration.

Attached to primary leg 101 are arms 110 (e.g., 110*a*, 110*b* and 110*c*). Arms 110 include top surfaces 103 (e.g., 103*a*, 103*b*, 103*c*), which can include a rubber pad or other non-slip material. Arms 110 can be spaced at intervals vertically along primary leg 101 and can be used to support materials, such as lumber. Arms 110 can be of any suitable width depending on the materials to be held. In a preferred embodiment, arms 110 are of a width similar to that of primary leg 101. The lengths of arms 110 can vary but preferably are not so long as to create an instability when loaded and are not so long as to overlap when folded flush against primary leg 101 (as described in more detail below).

Figure 2:
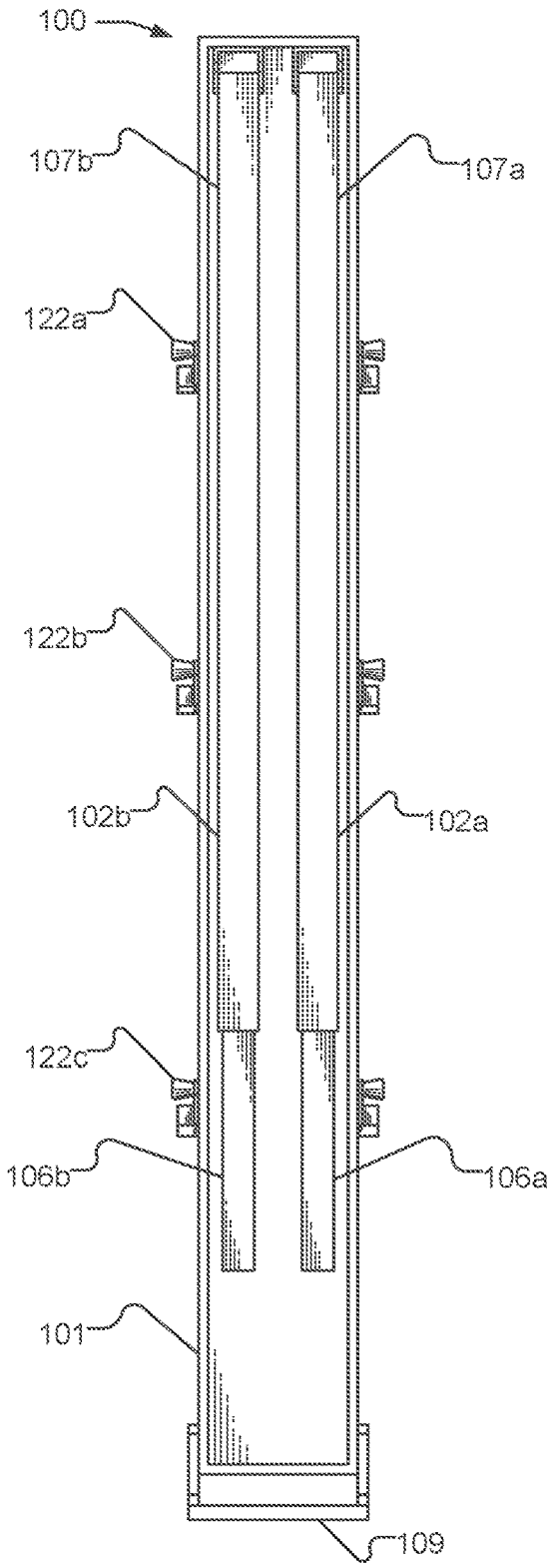
FIG. 2 is a rear view of a storage rack according to an embodiment of the present invention.

FIG. 2 shows storage rack 100 with secondary legs 102 folded into primary leg 101, which allows storage rack 100 to have a compact configuration for travel or stowing. In addition, in the compact configuration storage rack 100 can be mounted on a wall for convenient stowing or for use in holding other materials. While in a preferred embodiment primary leg 101 contains sufficient interior space to house secondary legs 102, alternatively the secondary legs and primary leg could fold together such that they are approximately parallel with each other. In either case, in the compact configuration the secondary and primary legs of storage rack 100 may additionally be secured together by a suitable mechanism, such as by friction fit, bands with hook and loop fasteners, or a clasp.

Figure 3A:
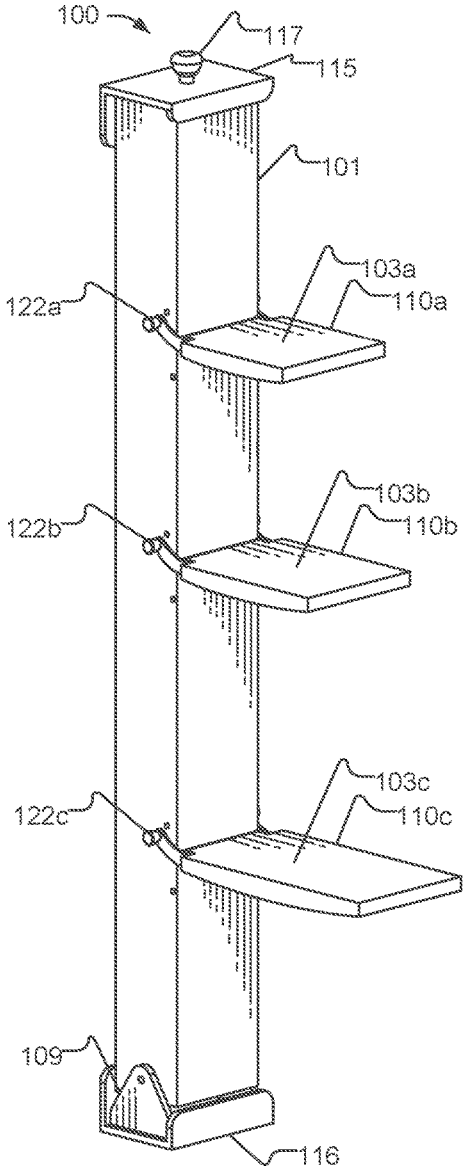
FIG. 3A is a perspective view of a storage rack according to another embodiment of the present invention.
Figure 3B:
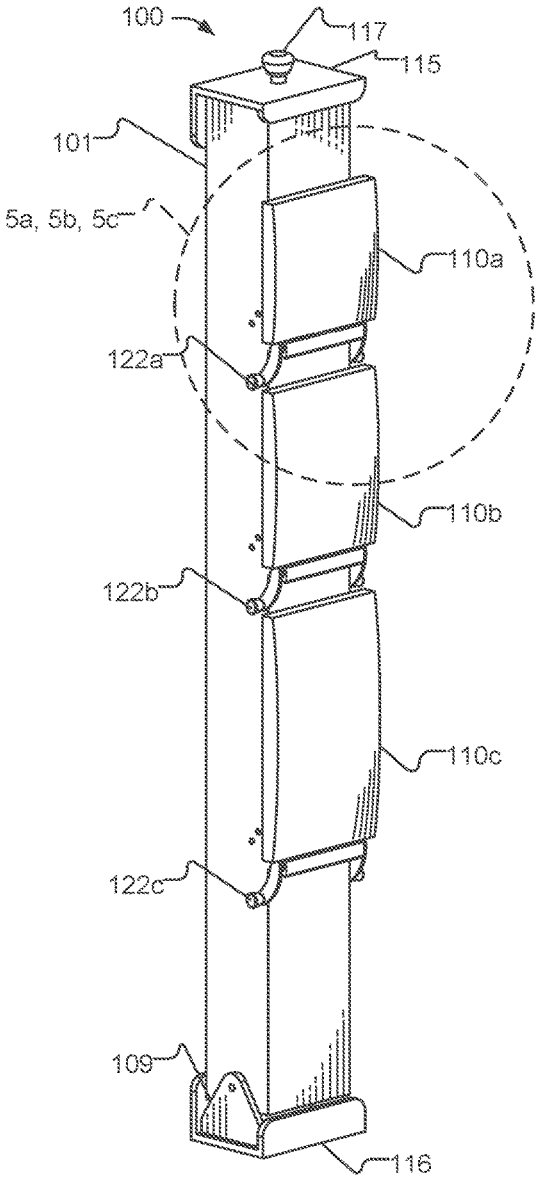
FIG. 3B is a perspective view of a storage rack according to another embodiment of the present invention.

FIG. 3A depicts storage rack 100 mounted in wall brackets with top surfaces 103 of arms 110 in a generally horizontal orientation. FIG. 3B depicts storage rack 100 mounted in wall brackets with top surfaces 103 of arms 110 generally flush against primary leg 101 (i.e., top surfaces 103 of arms 110 are substantially vertical in orientation when storage rack 100 is mounted on a wall and placed flush against primary leg 101). In both FIGS. 3A and 3B, secondary legs are folded into (or, alternatively, onto) primary leg 101 as described above.

Figure 4:
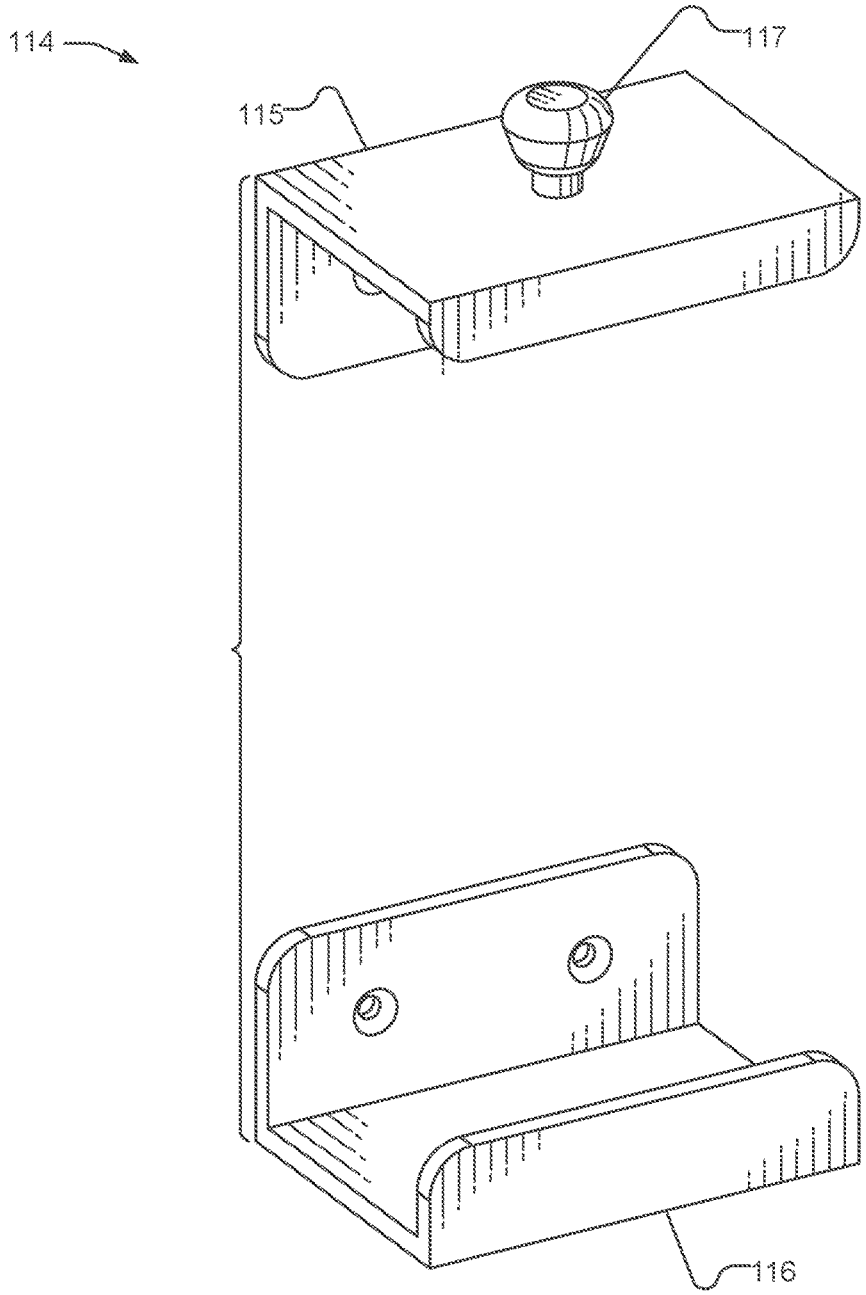
FIG. 4 is a perspective view of mounting brackets for securing a storage rack according to another embodiment of the present invention.

In the wall-mounted configuration, storage rack 100 may be secured to a wall using a wall mounting system 114, which is shown without storage rack 100 in FIG. 4 and includes a top mounting bracket 115, a bottom mounting bracket 116, and a handhold 117. Any mounting mechanism can be used, although preferably the mechanism would allow storage rack 100 to bear weight in an amount necessary so that storage rack 100 could hold materials such as lumber or tools while mounted to a wall. The top end of storage rack 100 can be attached to top mounting bracket 115 using any suitable mechanism such as grooves, friction fit, or clamps. Preferably, top mounting bracket 115 includes a locking member so that the top of storage rack 100 may be secured to top mounting bracket 115 once in place. For example, top mounting bracket may be under tension in a downward direction and vertically slidable sufficient so that without the presence of storage rack 100 a distance between bottom mounting rack 116 and top mounting bracket 115 is slightly less than the height of storage rack 100 when in the wall-mounted configuration. To place storage rack 100 in wall mounting system 114, a user could pull top mounting bracket 115 upwards using handhold 117, place base 109 in bottom mounting bracket 116 before lowering top mounting bracket 115 over the top end of storage rack 100 to secure storage rack 100 in wall mounting system 114. Base 109 may be releasably attached to bottom mounting bracket 116 by any suitable mechanism, such as friction fit, cotter pin, or clamping, in order to confer additional stability to storage rack 100 when mounted to a wall.

Bottom mounting bracket 116 may include a bottom portion that is angled or otherwise shaped in order to complimentarily receive base 109 of primary leg 101 so that storage rack 100 is better suited to bear weight when in the wall-mounted configuration and/or so that base 109 and the bottom portion of bottom mounting bracket 116 are less susceptible to wear and damage.

To allow arms 110 to be used at different angles, arms 110 may be pivotably attached to primary leg 101 via a locking mechanism that includes one or more stops as well as a locking mechanism that in conjunction allow arms 110 to be locked at any angle along a pivotable range. In a preferred embodiment, there are at least two stops so that arms 110 can be locked in at least angles along the pivotable range. In another preferred embodiment, there are at least three stops so that arms 110 can be locked in at least angles along the pivotable range. In another preferred embodiment, arms 110 can be locked in any angle along the pivotable range. Any suitable adjustment and locking mechanisms may be used. As can be seen in more detail in FIGS. 5A-5C, for example, arm connection assembly 120 includes a retractable pin connected to a pull knob 122, an optional a spring member or other tension device, and stop holes 124 (e.g., 124*a*, 124*b* or 124*c*). Pull knob 122 can engage or disengage the retractable pin in any of stop holes 124 in order to lock arm 110*a* at a particular angle or unlock arm 110 for changing positions.

Figure 5A:
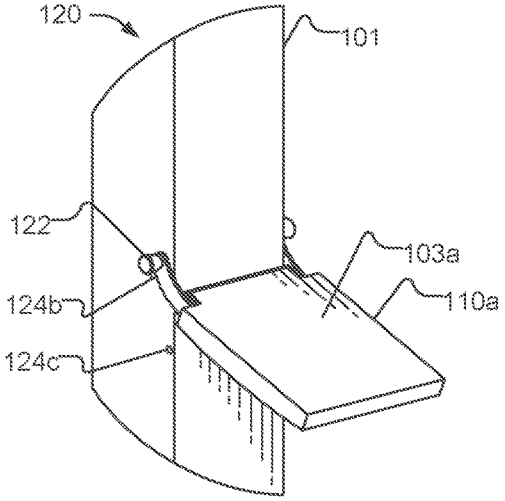
FIG. 5A is an exploded perspective view of a locking mechanism according to another embodiment of the present invention.

As shown in FIG. 5A, the retractable pin is engaged in hole 124*a*, locking arm 110*a* such that an angle formed between a front side of primary leg 101 and top surface 103*a* of arm 110*a* is appropriate for supporting materials when storage rack 100 is in the freestanding position. For example, an angle that would cause the top surface 103*a* of arm 110*a* to be generally horizontal when storage rack 100 is in the freestanding position may be selected. The appropriate angle between the front side of primary leg 101 and the top surface 103*a* of arm 110*a* for causing the top surface 103*a* of arm 110*a* to be substantially horizontal when storage rack 100 is in the freestanding position is determined by the angle primary leg 101 forms with respect to vertical when in place in the freestanding position. (FIG. 1 shows storage rack 100 in an exemplary freestanding position.) In particular, the appropriate angle between the front side of primary leg 101 and a top surface 103*a* of arm 110*a* for causing the top surface 103*a* of arm 110*a* to be substantially horizontal when storage rack 100 is in the freestanding position is the angle the front side of primary leg 101 forms with respect to vertical when storage rack 100 is in the freestanding position plus ninety degrees. It will be understood that other angles may be used if the desired position of the top surface 103*a* of arm 110*a* when storage rack 100 is in the freestanding position is other than substantially horizontal.

Figure 5B:
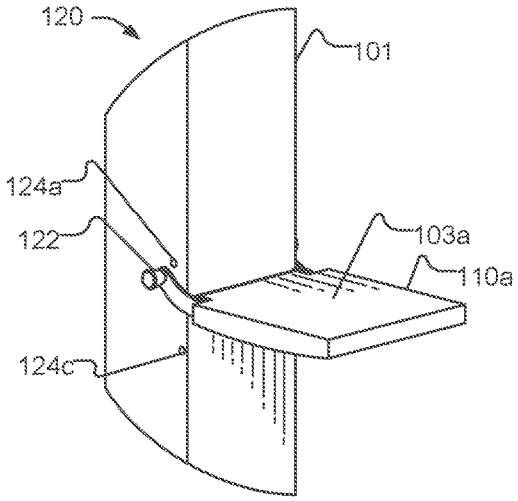
FIG. 5B is an exploded perspective view of a locking mechanism according to another embodiment of the present invention.

To adjust the arms to another angle, the retractable pin can be moved slidably out of stop hole 124*a*, at which point arm 110*a* can be pivoted upwardly until the retractable pin reaches stop hole 124*b*. The retractable pin can then be released into stop hole 124*b*, as shown in FIG. 5B, by releasing pull knob 122 and thereby locking arm 110*a* at an angle appropriate for holding materials when storage rack 100 is in the wall-mounted configuration. Preferably, the angle between the front side of primary leg 101 and the top surface 103*a* of arm 110*a* when storage rack 100 is in the wall-mounted configuration is approximately ninety degrees, which would cause the top surface 103*a* of arm 110*a* to be substantially horizontal. It will be understood that other angles could be used if the top surface 103*a* of arm 110*a* were desired to be other than horizontal when storage rack 100 is in the wall-mounted configuration.

Figure 5C:
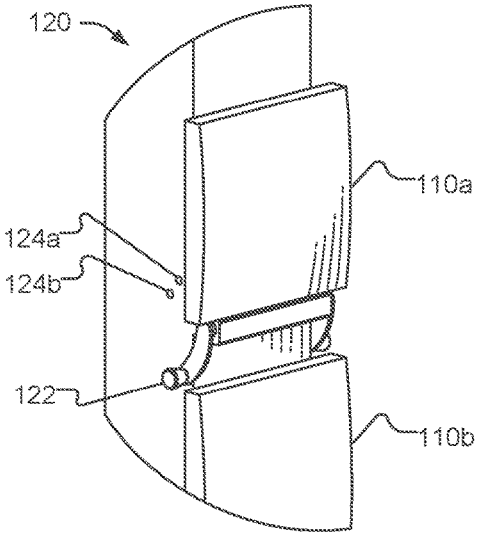
FIG. 5C is an exploded perspective view of a locking mechanism according to another embodiment of the present invention.

In the wall-mounted configuration, arms 110 may be locked at an appropriate angle for supporting materials, as described above. Alternatively, when not in use, arms 110 could be positioned flush against the front side of primary leg 101 in order to minimize the amount of space the storage rack takes up. To lock arms 110 in a position substantially flush with primary leg 101, the retractable pin can be released into stop hole 124*c*, as shown in FIG. 5C, by releasing pull knob 122 when the top surface 103*a* of arm 110*a* is substantially flush with primary leg 101, in which case the retractable pin would be aligned with stop hole 124*c*.

Placing one or more arms 110 in a position substantially flush with the front side of primary leg 101 may be useful when rack 100 is either in the freestanding or wall-mounted configuration. In the freestanding configuration, placing one or more arms 110 in a flush position would be done if fewer than all of arms 110 were needed for a particular task or storage operation. Similarly, some or all arms 110 may be placed in a flush position when rack 100 is in the wall-mounted configuration if some or all arms 110 were not being used to store items in order to allow rack 100 to take up less space. FIG. 3B shows storage rack 100 with arms 110 substantially flush with the front side of primary leg 101.

Further, arms 110 may be extendable and/or detachable. In this way, storage rack 100 could be used with the number of arms 110 best suited for a particular task or function. In addition, other attachments could be connected to arms 110 or replace arms 110 once removed. For example, attachments designed for holding different materials can be used, such as baskets, bike racks, kayak saddles, or storage containers with lids. Clamps, clasps or other grasping or securing mechanisms can also be included on arms 110 or be included for added or replacement attachments to hold materials more securely for storage or working on.

Figure 6:
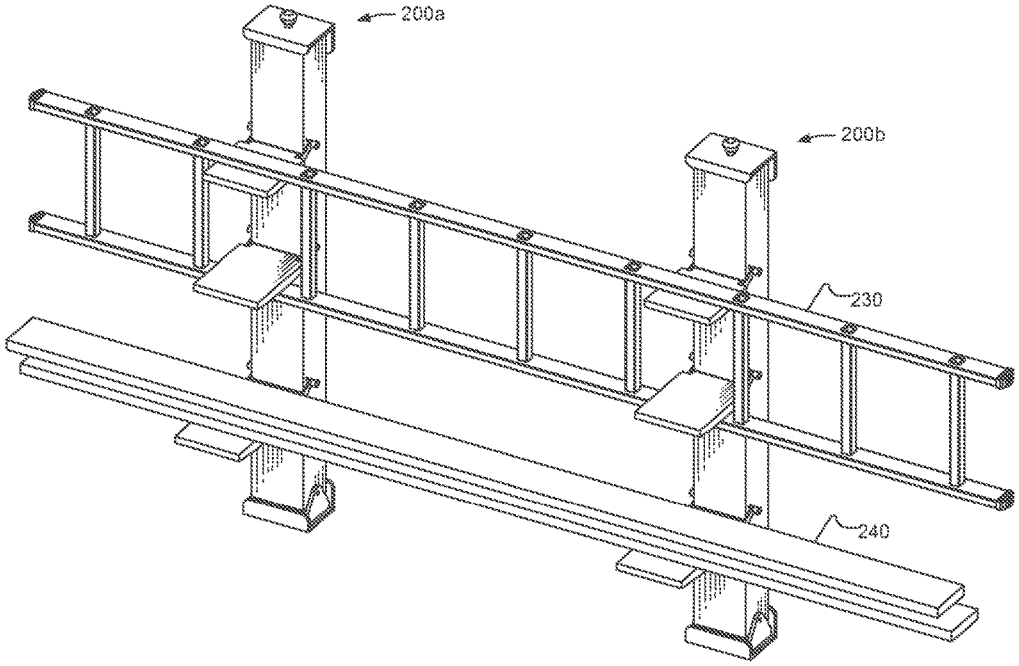
FIG. 6 is a perspective view of a storage rack system according to another embodiment of the present invention.
Figure 7:
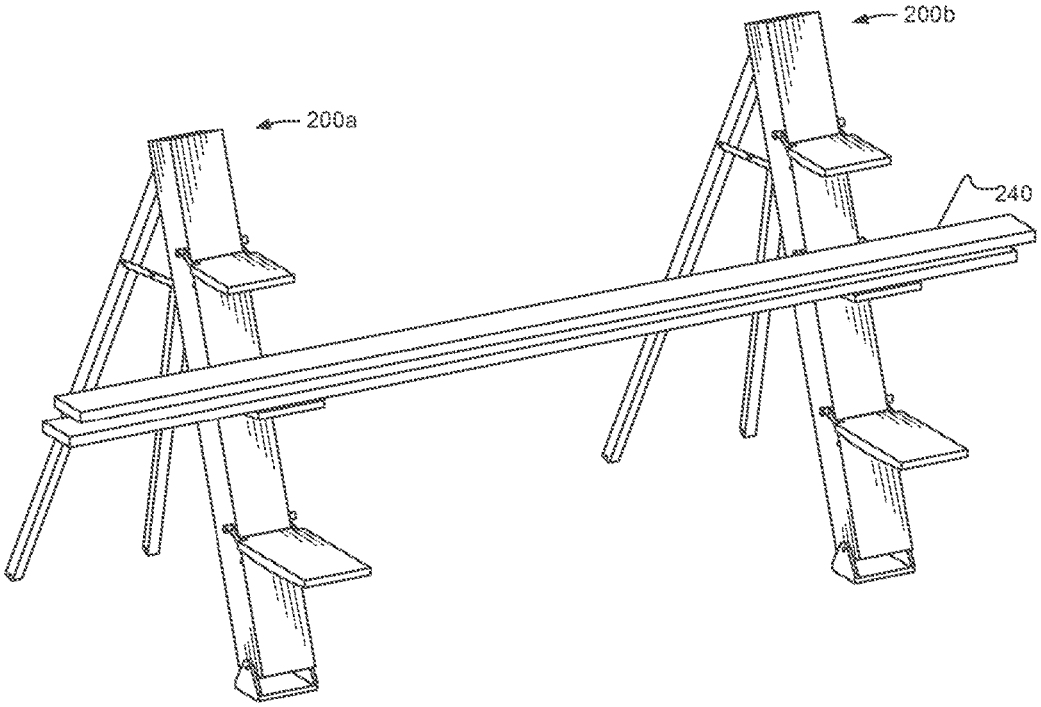
FIG. 7 is a perspective view of a storage rack system according to another embodiment of the present invention.

In both the freestanding configuration and the wall-mounted configuration, storage rack 100 may be used individually or in conjunction with one or more additional storage racks of the present invention. Longer materials such as lumber or pipes can be stored or worked on when more than one storage rack are used together, as shown in the examples in FIGS. 6 and 7. In FIG. 6, two wall-mounted storage racks 200 (200*a*, 200*b*) are used together to store a ladder 230 and lumber 240. In FIG. 7, the storage racks 200 are in freestanding configurations and are being used to hold lumber 240.

Components of the present invention may be of any suitable type, including metal, plastic and wood.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A device with a wall-mounted configuration and a freestanding configuration, comprising:

a first vertical support with a top end, a front side, and two side walls, the front side, top end, and two side walls defining a cavity, the first vertical support further including a plurality of horizontal support members pivotably attached at intervals to the first vertical support, wherein the horizontal support members can be releasably placed in at least two locked positions; and a plurality of second vertical supports hingeably attached to the top end of the first vertical support above the plurality of horizontal support members, wherein the first vertical support and the second vertical supports are configurable in two positions: in a first position, the first vertical support and second vertical supports form a freestanding support structure and in a second position the second vertical supports are collapsed such that the plurality of second vertical supports reside in the cavity and form a wall-mounted support structure.

2. A device according to claim 1, wherein said second vertical supports are adjustable in height.

3. A device according to claim 1, wherein the horizontal support members can be pivoted independently.

4. A device according to claim 1, wherein the horizontal support members each include a top surface and one of the locked positions of each of the horizontal support members causes the top surface to be substantially horizontal when the device is in the freestanding configuration and another one of the locked positions of each of the horizontal support members causes the top surface to be substantially horizontal when the device forms the wall-mounted support structure.

5. A storage device according to claim 1, wherein the horizontal support members include a third locked position in which the top surface of the horizontal support member is substantially flush with the front side of the first vertical support.

6. A system for storing and supporting materials, comprising:

a device with a wall-mounted configuration and a freestanding configuration including:

a first vertical support with an interior space, a top end and a front side;

two second vertical supports hingeably attached to the top end of the first vertical support, wherein the second vertical supports are designed and configured to be housed within the interior space to form the wall-mounted configuration and wherein the second vertical supports are designed and configured to be extended at an angle out from the top end of the first vertical support such that the first vertical support and the second vertical supports support the device in a freestanding position; and a plurality of horizontal support members pivotably attached at intervals to the first vertical support below a location where the two second vertical supports are attached to the first vertical support, each horizontal support member having a top surface, wherein the horizontal support members are configured to be secured in at least three positions including a first position in which the top surface is substantially flush with the front side of the first vertical support, a second position in which the top surface extends away from the front side of the first vertical support and is substantially horizontal when the device is in the freestanding position, and a third position in which the top surface extends away from the front side of the first vertical support and is substantially perpendicular to the front side of the first vertical support when the device is in the wall-mounted configuration; and a wall mounting system including a top mounting bracket and a bottom mounting bracket, wherein the wall mounting system is designed and configured to support the device when the device is in the wall-mounted configuration with the top end secured in the top mounting bracket.

7. A storage and support system for materials, comprising:

a plurality of racks, each of the plurality of racks including:

a first vertical support with an interior space, a top end and a front side;

two vertical supports hingeably attached to the top end of the first vertical support, wherein the second vertical supports are designed and configured to be housed within the interior space to form a wall-mounted configuration of the rack and wherein the second vertical supports are designed and configured to be extended at an angle out from the top end of the first vertical support such that the first vertical support and the second vertical supports support the device in a freestanding position; and a horizontal support member having a width and being pivotably attached to the first vertical support at a location below a point where the two vertical supports are attached to the first vertical support, the horizontal support member having a top surface, wherein the horizontal support member is configured to be secured in three positions including a first position in which the top surface is substantially flush with the front side of the first vertical support, a second position in which the top surface extends away from the front side of the first vertical support and is substantially horizontal when the rack is in the freestanding position, and a third position in which the top surface extends away from the front side of the first vertical support and is substantially perpendicular to the first vertical support when the rack is in the wall-mounted configuration; and a plurality of wall mounting systems, each of the plurality of wall mounting systems being designed and configured to support a one of the plurality of racks in a vertical orientation on a wall when the one of the plurality of racks is in the wall-mounted configuration, wherein the plurality of racks are configured such that, when the plurality of racks are aligned in freestanding positions and in wall-mounted configurations supported in respective ones of the plurality of wall mounting systems, the horizontal support member of each of the plurality of racks is configured to support a portion of construction materials that are substantially longer than the width of any horizontal support member of any of the plurality of racks.

* * * * *